US008093179B2

(12) United States Patent
O'Neil

(10) Patent No.: US 8,093,179 B2
(45) Date of Patent: Jan. 10, 2012

(54) STABLE AQUEOUS DISPERSIONS OF COLOUR DEVELOPER

(75) Inventor: Robert Montgomery O'Neil, Manchester (GB)

(73) Assignee: BASF SE, Lugwigshafen (DE)

( * ) Notice: Subject to any disclaimer, the term of this patent is extended or adjusted under 35 U.S.C. 154(b) by 976 days.

(21) Appl. No.: 11/989,166

(22) PCT Filed: Jul. 19, 2006

(86) PCT No.: PCT/EP2006/064387

§ 371 (c)(1), (2), (4) Date: Jan. 22, 2008

(87) PCT Pub. No.: WO2007/014847

PCT Pub. Date: Feb. 8, 2007

(65) Prior Publication Data

US 2009/0093362 A1 Apr. 9, 2009

(30) Foreign Application Priority Data

Jul. 28, 2005 (EP) ..... 05106950

(51) Int. Cl.
*B41M 5/333* (2006.01)
*B41M 5/335* (2006.01)

(52) U.S. Cl. ..... 503/209; 106/31.17; 503/216; 503/225

(58) Field of Classification Search ..... None
See application file for complete search history.

(56) References Cited

U.S. PATENT DOCUMENTS

| | | | | |
|---|---|---|---|---|
| 4,604,436 | A | 8/1986 | Thorpe et al. | 525/504 |
| 4,929,710 | A * | 5/1990 | Scholl et al. | 528/205 |
| 5,421,870 | A | 6/1995 | Scartazzini et al. | 106/21 |
| 5,880,064 | A | 3/1999 | Kagota et al. | 50/213 |
| 6,624,117 | B1 * | 9/2003 | Heneghan et al. | 503/216 |
| 2003/0040434 | A1 | 2/2003 | Fujita et al. | 503/216 |

FOREIGN PATENT DOCUMENTS

| | | |
|---|---|---|
| EP | 1 264 707 | 12/2002 |
| EP | 1 140 515 | 9/2004 |

OTHER PUBLICATIONS

Patent Abstracts of Japan Pub. No. 2004284262, Oct. 2004.
Patent Abstracts of Japan Pub. No. 2003292807, Oct. 2003.

* cited by examiner

*Primary Examiner* — Bruce H Hess
(74) *Attorney, Agent, or Firm* — Drinker Biddle & Reath

(57) ABSTRACT

Storage-stable compositions comprising a color developer, an anionic dispersant and a thickening agent as well as heat-sensitive recording materials comprising such compositions, a process for its manufacture and its use.

8 Claims, No Drawings

STABLE AQUEOUS DISPERSIONS OF COLOUR DEVELOPER

CORRESPONDENCE TO RELATED APPLICATIONS

This application is the National Stage of International Application No. PCT/EP2006/064387, filed on Jul. 19, 2006, which claims benefit of European Application No. 05106950.8, filed Jul. 28, 2005.

This invention relates to compositions comprising a colour developer, an anionic dispersant and a thickening agent as well as to heat-sensitive recording materials comprising such compositions, a process for its manufacture and its use.

Heat-sensitive recording is a well known technique and is used as a system for recording transferred information through the mediation of heat, by utilising a colour reaction between a colour forming compound and a developer.

A need exists to produce an aqueous dispersion of a colour developer that is low in viscosity, such that it can be pumped and handled easily, has high active ingredient content, e.g. in order to reduce transportation costs, is storage-stable in particular with regard to sedimentation, and is economic to produce, i.e. uses low amounts of other ingredients such as anionic dispersants.

JP 2004-284262 discloses mixtures of the colour developer N-p-toluenesulfonyl-N'-3-(p-toluenesulfonyloxy)phenylurea and the anionic dispersant Gohseran®L3266, in which the concentration of the colour developer is 36.4%. JP 2003-292807 discloses a mixture of the same colour developer together with a 10% aqueous solution of a sulfonated polyvinylalcohol, wherein the concentration of the colour developer is 40%.

It is therefore an object of the present invention to provide a composition with an even higher concentration of the colour developer and which is storage-stable. Another object is to provide corresponding heat-sensitive recording materials comprising such a composition, wherein the oil resistance and the initial image intensity are not deteriorated The present invention is directed to a composition, which comprises a colour developer of the general formula I

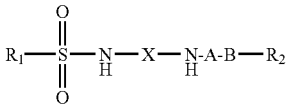

wherein $R_1$ is phenyl or naphthyl, which can be unsubstituted or substituted by $C_1$-$C_8$alkyl, $C_1$-$C_8$-alkoxy or halogen; or $C_1$-$C_{20}$alkyl, which can be unsubstituted or substituted by $C_1$-$C_8$-alkoxy or halogen, X is a group of the formula —C(═NH)—, —C(═S)— or —C(═O)—, A is unsubstituted or substituted phenylene, naphthylene or $C_1$-$C_{12}$alkylene, or is an unsubstituted or substituted heterocyclic group, B is a linking group of formula —O—$SO_2$—, —$SO_2$—O—, —NH—$SO_2$—, —$SO_2$—NH—, —S—$SO_2$—, —O—CO—NH—, —NH—CO—, —NH—CO—O—, —S—CO—NH—, —S—CS—NH—, —CO—NH—$SO_2$—, —O—CO—NH—$SO_2$—, —NH═CH—, —CO—NH—CO—, —S—, —CO—, —O—, —$SO_2$—NH—CO—, —O—CO—O— and —O—PO—$(OR_2)_2$, and $R_2$ is aryl, preferably phenyl or naphthyl, which can be unsubstituted or substituted by $C_1$-$C_8$alkyl, halogen-substituted $C_1$-$C_8$alkyl, $C_1$-$C_8$alkoxy-substituted $C_1$-$C_8$alkyl, $C_1$-$C_8$alkoxy, halogen-substituted $C_1$-$C_8$alkoxy or halogen; or benzyl, which can be substituted by $C_1$-$C_8$alkyl, halogen-substituted $C_1$-$C_8$alkyl, $C_1$-$C_8$alkoxy-substituted $C_1$-$C_8$alkyl, $C_1$-$C_8$alkoxy, halogen-substituted $C_1$-$C_8$alkoxy or halogen; or $C_1$-$C_{20}$alkyl, which can be unsubstituted or substituted by $C_1$-$C_8$alkoxy, halogen, phenyl or naphthyl, and a) 0.1 to 5, preferably 0.1 to 3.0 dry parts per 100 dry parts of colour developer I by weight of an anionic dispersant and b) 0.01 to 2.0, preferably 0.01 to 1.0, more preferably 0.01 to 0.5 dry parts per 100 parts of colour developer I per weight of a thickening agent.

$R_1$ as phenyl or naphthyl can be unsubstituted or substituted by, for example, $C_1$-$C_8$alkyl, $C_1$-$C_8$alkoxy or halogen. Preferred substituents are $C_1$-$C_4$alkyl, especially methyl or ethyl, $C_1$-$C_4$alkoxy, especially methoxy or ethoxy, or halogen, especially chlorine. $R_1$ as naphthyl is preferably unsubstituted. $R_1$ as phenyl is preferably substituted, especially by one of the above alkyl substituents.

$R_1$ as $C_1$-$C_{20}$alkyl can be unsubstituted or substituted by, for example $C_1$-$C_8$alkoxy or halogen. Preferred substituents are $C_1$-$C_4$alkoxy, especially methoxy or ethoxy, or halogen, especially chlorine. $R_1$ as $C_1$-$C_{20}$alkyl is preferably unsubstituted.

Preferably, $R_1$ is phenyl which is unsubstituted or substituted by $C_1$-$C_8$alkyl, $C_1$-$C_8$alkoxy or halogen. Of most importance are the substituted phenyl groups. Highly preferred are phenyl groups which are substituted by $C_1$-$C_4$alkyl, preferably by methyl.

X is preferably a group of the formula —S(═O)— or —C(═O)—, especially —C(═O)—.

A as a phenylene or naphthylene group can be unsubstituted or substituted by, for example, $C_1$-$C_8$alkyl, halogen-substituted $C_1$-$C_8$alkyl, $C_1$-$C_8$alkoxy-substituted $C_1$-$C_8$alkyl, $C_1$-$C_8$alkoxy, halogen-substituted $C_1$-$C_8$alkoxy, $C_1$-$C_8$alkylsulphonyl, halogen, phenyl, phenoxy or phenoxycarbonyl. Preferred alkyl and alkoxy substituents are those containing 1 to 4 carbon atoms. Preferred substituents are $C_1$-$C_8$alkyl, halogen-substituted $C_1$-$C_8$alkyl, $C_1$-$C_8$alkyl-sulphonyl or halogen. A as a naphthylene group is preferably unsubstituted.

A as a heterocyclic group is preferably pyrimidylene which is unsubstituted or substituted by $C_1$-$C_8$alkyl, especially by $C_1$-$C_4$alkyl.

A as a $C_1$-$C_{12}$alkylene group is preferably $C_1$-$C_8$alkylene, especially $C_1$-$C_4$alkylene.

Preferred groups A are phenylene groups which are unsubstituted or substituted by $C_1$-$C_8$alkyl, halogen-substituted $C_1$-$C_8$alkyl, $C_1$-$C_8$alkoxy-substituted $C_1$-$C_8$alkyl, $C_1$-$C_8$alkoxy, halogen-substituted $C_1$-$C_8$alkoxy, $C_1$-$C_8$alkylsulphonyl, halogen, phenyl, phenoxy or phenoxycarbonyl, especially $C_1$-$C_8$alkyl, halogen-substituted $C_1$-$C_8$alkyl, $C_1$-$C_8$alkylsulphonyl or halogen.

Highly preferred groups A are phenylene groups which are unsubstituted or substituted by $C_1$-$C_4$alkyl or halogen, especially unsubstituted phenylene groups.

Preferred linking groups B are those of formulae —O—$SO_2$—, —$SO_2$—O—, —$SO_2$—NH—, —S—$SO_2$—, —O—, —O—CO— and —O—CO—NH—, especially linking groups of formulae —O—$SO_2$—, —$SO_2$—O— and —$SO_2$—NH—. Highly preferred are the linking groups B of formula —O—$SO_2$— and —O—.

$R_2$ as aryl is preferably phenyl or naphthyl which can be unsubstituted or substituted by, for example, $C_1$-$C_8$alkyl, halogen-substituted $C_1$-$C_8$alkyl, $C_1$-$C_8$alkoxy-substituted $C_1$-$C_8$alkyl, $C_1$-$C_8$alkoxy, halogen-substituted $C_1$-$C_8$alkoxy or halogen. Preferred alkyl and alkoxy substituents are those containing 1 to 4 carbon atoms. Preferred substituents are $C_1$-$C_4$alkyl and halogen. $R_2$ as naphthyl is preferably unsubstituted.

$R_2$ as benzyl can be substituted by the substituents given for $R_2$ as phenyl or naphthyl. Unsubstituted benzyl is preferred.

$R_2$ as $C_1$-$C_{20}$alkyl is preferably $C_1$-$C_8$alkyl, especially $C_1$-$C_6$alkyl, and can be unsubstituted or substituted by, for example, $C_1$-$C_8$alkoxy, halogen, phenyl or naphthyl. Preferred are the unsubstituted alkyl groups, especially $C_1$-$C_4$alkyl.

Preferred groups $R_2$ are $C_1$-$C_6$alkyl; halogen-substituted $C_1$-$C_6$alkyl; phenyl-substituted $C_1$-$C_6$alkyl; naphthyl-substituted $C_1$-$C_6$alkyl; phenyl which is unsubstituted or substituted by $C_1$-$C_8$alkyl, halogen-substituted $C_1$-$C_8$alkyl, $C_1$-$C_8$alkoxy-substituted $C_1$-$C_8$alkyl, $C_1$-$C_8$alkoxy, halogen-substituted $C_1$-$C_8$alkoxy or halogen; naphthyl and benzyl which is substituted by $C_1$-$C_4$alkyl or halogen.

Highly preferred groups $R_2$ are $C_1$-$C_4$alkyl; halogen-substituted $C_1$-$C_4$alkyl; phenyl which is unsubstituted or substituted by $C_1$-$C_4$alkyl or halogen; naphthyl and benzyl which is unsubstituted or substituted by $C_1$-$C_4$alkyl or halogen, especially phenyl which is unsubstituted or substituted by $C_1$-$C_4$alkyl.

Preferred are developers of formula (1), wherein $R_1$ is phenyl which is substituted by $C_1$-$C_4$alkyl, preferably by methyl, X is a group of the formula —C(═O)—, A is phenylene which is unsubstituted or substituted by $C_1$-$C_4$alkyl or halogen, preferably unsubstituted phenylene, like 1,3-phenylene, B is a linking group of formula —O—$SO_2$— or —O— and $R_2$ is phenyl, naphthyl or benzyl which is unsubstituted or substituted by $C_1$-$C_4$alkyl or halogen, especially phenyl which is substituted by $C_1$-$C_4$alkyl.

The compounds of formula (1) are known or can be prepared as disclosed e.g. in EP 1,140,515.

A preferred embodiment of the instant invention concerns the inventive composition, in which a colour developer of formula (1) is chosen, wherein $R_1$ is phenyl which is substituted by $C_1$-$C_4$alkyl, preferably by methyl, X is a group of the formula —C(═O)—, A is phenylene which is unsubstituted or substituted by $C_1$-$C_4$alkyl or halogen, preferably unsubstituted phenylene, like 1,3-phenylene, B is a linking group of formula —O—$SO_2$— or —O— and $R_2$ is phenyl, naphthyl or benzyl which is unsubstituted or substituted by $C_1$-$C_4$alkyl or halogen, especially phenyl which is substituted by $C_1$-$C_4$alkyl.

Preferably the anionic dispersant is a sulfonated polyvinylalcohol preferably exhibiting a saponification degree of 86.5 to 89.0 mol-% and a viscosity of 2.3 to 2.7 mPa·s for a 4% by weight solution at 20° C. Such anionic dispersants are known in the art, an example would be Gohseran®L3266 (from Nippon Gohsei).

Alternatively, the anionic dispersant may be an aromatic sulfonic acid, e.g. an ammonium salt of naphthalene sulfonic acid formaldehyde condensate such as Dehscofix®930 (from Huntsman Performance Products) or a carboxylated polymer such as Ciba®Glascol®LS 16, a carboxylated acrylic copolymer manufactured by Ciba Specialty Chemicals Inc.

As thickening agent or thickeners usually the known materials can be used in order to increase viscosity, i.e. natural organic thickening agents such as agar-agar, alginates, e.g. sodium alginate, pectines, starch, which can be usually modified such as hydroxypropylated starch, caseine, xanthan gum, preferably xanthan gum, synthetic organic thickening agents such as water-soluble carboxylates, e.g. carboxymethylcellulose, or polymers or copolymers based on acrylamide, acrylic acid, methacrylic acid or ethylacrylate, or inorganic thickening agents such as polysilicates, clay minerals such as montmorillonites, or zeolithes.

A preferred embodiment therefore concerns an inventive composition, wherein the thickening agent is selected from the group consisting of xanthan gum, sodium alginate, water-soluble carboxylates, polymers or copolymers based on acrylamide, acrylic acid, ethyl acrylate or methacrylic acid.

Furthermore, another embodiment relates to the use of thickening agents for the manufacturing of storage-stable colour developer compositions.

In another preferred embodiment the inventive composition comprises as an additional component a biocide. Generally, the known biocides in this field can be used, preferred are e.g. Acticide®MBS (a mixture of isothiazolones from Thor GmbH), Biochek®410 (a mixture of 1,2-dibromo-2,4-dicyanobutane and 1,2-benzisothiazolin-3-one from Lanxess Deutschland GmbH), Biochek®721M (a mixture of 1,2-dibromo-2,4-dicyanobutane and 2-bromo-2-nitro-1,3-propandiol from Lanxess Deutschland GmbH) or Metasol®TK 100 (2-(4-thiazolyl)-benzimidazole from Lanxess Deutschland GmbH).

Usually, the biocide is added in amounts from 0.01 to 2.0, preferably from 0.1 to 1.5% by weight, based on the amount of the colour developer I.

Another preferred embodiment of this invention relates to compositions, in which the concentration of the colour developer is at least 50%, i.e. dispersions which comprise a) at least 50% by weight of colour developer I b) an anionic dispersant, in an amount from 0.1 to 5 dry parts per 100 parts of dry colour developer I, c) a thickening agent, in an amount from 0.01 to 2.0 dry parts per 100 parts of dry colour developer I, d) optionally a biocide, and e) rest water, which adds up to 100%.

The inventive compositions usually are manufactured by first blending together at ambient temperature the colour developer I with the anionic dispersant and, if required, a biocide and water. The colour developer I may be employed in the form of a dry powder, or preferably as a water-wet filter cake. As a rule, the mixture is then mixed thoroughly with a high shear stirring device to produce a coarse dispersion. The coarse dispersion is preferably then processed further in a mill or attritor until the desired reduction in particle size of colour developer I is achieved. Suitable mills include horizontal and vertical bead mills that may operate with re-circulation. The average particle size of colour developer I after further processing is normally in the range 0.2 to 2.0 μm, preferably in the range of 0.5 to 1.5 μm. The resulting fine dispersion is usually then blended with a solution of the thickening agent to yield the inventive stable aqueous dispersion.

Therefore another embodiment of the instant invention relates to a process for the manufacture of the inventive composition, wherein a) a colour developer I, an anionic dispersant and water are mixed together, optionally with a biocide, preferably at ambient temperature, b) the such obtained mixture is further treated in order to obtain an average particle size in the range of from 0.2 to 2.0 μm, and c) blending the treated mixture of step b) with a thickening agent.

The inventive compositions generally are used as for the manufacture of storage-stable colour developer compositions as well as for heat-sensitive recording materials.

A further embodiment of this invention relates to a heat-sensitive recording material comprising a) a colour forming compound, and b) the inventive composition.

Usually the amounts of colour forming compound and the inventive composition are choosen in such a way, that the weight ratio of colour forming compound to colour developer I is in the range of from 1:1.5 to 1:5.0, preferably from 1:1.8 to 1:3.5.

The colour forming compounds are, for example, triphenylmethanes, lactones, benzoxazines, spiropyrans or preferably fluorans.

Preferred colour formers include but are not limited to; 3-diethylamino-6-methylfluoran, 3-dimethylamino-6-methyl-7-anilinofluoran, 3-diethylamino-6-methyl-7-anilinofluoran, 3-diethylamino-6-methyl-7-(2,4-dimethylanilino) fluoran, 3-diethylamino-6-methyl-7-chlorofluoran, 3-diethylamino-6-methyl-7-(3-trifluoromethylanilino) fluoran, 3-diethylamino-6-methyl-7-(2-chloroanilino) fluoran, 3-diethylamino-6-methyl-7-(4-chloroanilino) fluoran, 3-diethylamino-6-methyl-7-(2-fluoroanilino) fluoran, 3-diethylamino-6-methyl-7-(4-n-octylanilino) fluoran, 3-diethylamino-7-(4-n-octylanilino) fluoran, 3-diethylamino-7-(n-octylamino) fluoran, 3-diethylamino-7-(dibenzylamino) fluoran, 3-diethylamino-6-methyl-7-(dibenzylamino) fluoran, 3-diethylamino-6-chloro-7-methylfluoran, 3-diethylamino-7-t-butylfluoran, 3-diethylamino-7-carboxyethylfluoran, 3-diethylamino-6-chloro-7-anilinofluoran, 3-diethylamino-6-methyl-7-(3-methylanilino) fluoran, 3-diethylamino-6-methyl-7-(4-methylanilino) fluoran, 3-diethylamino-6-ethoxyethyl-7-anilinofluoran, 3-diethylamino-7-methylfluoran, 3-diethylamino-7-chlorofluoran, 3-diethylamino-7-(3-trifluoromethylanilino) fluoran, 3-diethylamino-7-(2-chloroanilino) fluoran, 3-diethylamino-7-(2-fluoroanilino) fluoran, 3-diethylamino-benzo[a]fluoran, 3-diethylamino-benzo[c]fluoran, 3-dibutylamino-7-dibenzylaminofluoran, 3-dibutylamino-7-anilinofluoran, 3-diethylamino-7-anilinofluoran, 3-dibutylamino-6-methyl fluoran, 3-dibutylamino-6-methyl-7-anilinofluoran, 3-dibutylamino-6-methyl-7-(2,4-dimethylanilino) fluoran, 3-dibutylamino-6-methyl-7-(2-chloroanilino) fluoran, 3-dibutylamino-6-methyl-7-(4-chloroanilino) fluoran, 3-dibutylamino-6-methyl-7-(2-fluoroanilino) fluoran, 3-dibutylamino-6-methyl-7-(3-trifluoromethylanilino) fluoran, 3-dibutylamino-6-ethoxyethyl-7-anilinofluoran, 3-dibutylamino-6-chloroanilinofluoran, 3-dibutylamino-6-methyl-7-(4-methylanilino) fluoran, 3-dibutylamino-7-(2-chloroanilino) fluoran, 3-dibutylamino-7-(2-fluoroanilino) fluoran, 3-dibutylamino-7-(N-methyl-N-formylamino) fluoran, 3-dipentylamino-6-methyl-7-anilinofluoran, 3-dipentylamino-6-methyl-7-(4-2-chloroanilino) fluoran, 3-dipentylamino-7-(3-trifluoromethylanilino) fluoran, 3-dipentylamino-6-chloro-7-anilinofluoran, 3-dipentylamino-7-(4-chloroanilino) fluoran, 3-pyrrolidino-6-methyl-7-anilinofluoran, 3-piperidino-6-methyl-7-anilinofluoran, 3-(N-methyl-N-propylamino)-6-methyl-7-anilinofluoran, 3-(N-methyl-N-cyclohexylamino)-6-methyl-7-anilinofluoran, 3-(N-ethyl-N-cyclohexylamino)-6-methyl-7-anilinofluoran, 3-(N-ethyl-p-toluidino)-6-methyl-7-anilinofluoran, 3-(N-ethyl-N-isoamylamino)-6-methyl-7-anilinofluoran, 3-(N-ethyl-N-isoamylamino)-6-chloro-7-anilinofluoran, 3-(N-ethyl-N-tetrahydrofurfurylamino)-6-methyl-7-anilinofluoran, 3-(N-ethyl-N-isobutylamino)-6-methyl-7-anilinofluoran, 3-(N-butyl-N-isoamylamino)-6-methyl-7-anilinofluoran, 3-(N-isopropyl-N-3-pentylamino)-6-methyl-7-anilinofluoran, 3-(N-ethyl-N-ethoxypropylamino)-6-methyl-7-anilinofluoran, 3-cyclohexylamino-6-chlorofluoran, 2-methyl-6-p-(p-dimethylaminophenyl)aminoanilinofluoran, 2-methoxy-6-p-(p-dimethylaminophenyl)aminoanilinofluoran, 2-chloro-3-methyl-6-p-(p-phenylaminophenyl)aminoanilinofluoran, 2-diethylamino-6-p-(p-dimethylaminophenyl)aminoanilinofluoran, 2-phenyl-6-methyl-6-p-(p-phenylaminophenyl) aminoanilinofluoran, 2-benzyl-6-p-(p-phenylaminophenyl) aminoanilinofluoran, 3-methyl-6-p-(p-dimethylaminophenyl)aminoanilinofluoran, 3-diethylamino-6-p-(p-diethylaminophenyl)aminoanilinofluoran, 3-diethylamino-6-p-(p-dibutylaminophenyl)aminoanilinofluoran, 2,4-dimethyl-6-[(4-dimethylamino)anilino] fluoran, 3-[(4-dimethylaminophenyl)amino]-5,7-dimethylfluoran, 3,6,6'-tris(dimethylamino)spiro[fluorene-9,3'-phthalide], 3,6,6'-tris(diethylamino)spiro[fluorene-9,3'-phthalide], 3,3-bis(p-dimethylaminophenyl)-6-dimethylaminophthalide, 3,3-bis(p-dimethylaminophenyl) phthalide, 3,3-bis-[2-(p-dimethylaminophenyl)-2-(p-methoxyphenyl)ethenyl-4,5,6,7-tetrabromophthalide, 3,3-bis-[2-(p-dimethylaminophenyl)-2-(p-methoxyphenyl) ethenyl-4,5,6,7-tetrachlorophthalide, 3,3-bis[1,1-bis(4-pyrrolidinophenyl)ethylene-2-yl]-4,5,6,7-tetrabromophthalide, 3,3-bis-[1-(4-methoxyphenyl)-1-(4-pyrridinophenyl)ethylene-2-yl]-4,5,6,7-tetrachlorophthalide, 3-(4-diethylamino-2-ethoxyphenyl)-3-(1-ethyl-2-methylindole-3-yl)-4-azaphthalide, 3-(4-diethylamino-2-ethoxyphenyl)-3-(1-octyl-2-methylindole-3-yl)-4-azaphthalide, 3-(4-cyclohexylethylamino-2-methoxyphenyl)-3-(1-ethyl-2-methylindole-3-yl)-4-azaphthalide, 3,3-bis(1-ethyl-2-methylindole-3-yl) phthalide, 3,3-bis(1-octyl-2-methylindole-3-yl) phthalide, mixture of 2-phenyl-4-(4-diethylaminophenyl)-4-(4-methoxyphenyl)-6-methyl-7-dimethylamino-3,1-benzoxazine and 2-phenyl-4-(4-diethylaminophenyl)-4-(4-methoxyphenyl)-8-methyl-7-dimethylamino-3,1-benzoxazine, 4,4'-[1-methylethylidene)bis(4,1-phenyleneoxy-4,2-quinazolinediyl)]bis[N,N-diethylbenzenamine], bis(N-methyidiphenylamine)-4-yl-(N-butylcarbazole)-3-yl-methane and mixtures thereof.

All of the above colour forming compounds can be used singly or as a mixture with other colour forming compounds; or they may also be used together with further black colour forming compounds.

Highly preferred are 3-diethylamino-6-methyl-7-anilinofluoran, 3-diethylamino-6-methyl-7-(3-methylanilino) fluoran, 3-diethylamino-6-methyl-7-(2,4-dimethylanilino) fluoran, 3-dibutylamino-6-methyl-7-anilinofluoran, 3-dipentylamino-6-methyl-7-anilinofluoran, 3-(N-methyl-N-propylamino)-6-methyl-7-anilinofluoran, 3-(N-methyl-N-cyclohexylamino)-6-methyl-7-anilinofluoran, 3-(N-ethyl-N-isoamylamino)-6-methyl-7-anilinofluoran, 3-diethylamino-6-chloro-7-anilinofluoran, 3-dibutylamino-7-(2-chloroanilino)fluoran, 3-N-ethyl-p-toluidino-6-methyl-7-anilinofluoran, 3-(N-ethyl-N-tetrahydrofurfurylamino)-6-methyl-7-anilinofluoran, 3-(N-ethyl-N-isobutylamino)-6-methyl-7-anilinofluoran, 3-N-ethyl-N-ethoxypropylamino-6-methyl-7-anilinofluoran, 2,4-dimethyl-6-[(4-dimethylamino)anilino]fluoran, 3-(4-diethylamino-2-ethoxyphenyl)-3-(1-octyl-2-methylindole-3yl)-4-azaphthalide, 3,3-bis(p-dimethylaminophenyl)-6-dimethylaminophthalide and mixtures thereof.

It is also possible to use solid solutions comprising at least two colour forming compounds.

A monophase (or single-phase or guest-host) solid solution possesses a crystal lattice which is identical with the crystal lattice of one of its components. One component is embedded as the 'guest' in the crystal lattice of the other component, which acts as the 'host'. The X-ray diffraction pattern of such a monophase solid solution is substantially identical to that of one of the components, called the 'host'. Within certain limits, different proportions of the components produce almost identical results.

In the literature, the definitions by the various authors, such as, G. H. Van't Hoff, A. I. Kitaigorodsky and A. Whitacker for solid solutions and mixed crystals are often contradictory, (cf, e.g. 'Analytical Chemistry of Synthetic Dyes', Chapter 10/page 269, Editor K. Venkataraman, J. Wiley, New York, 1977).

The term 'monophase solid solution' or 'multiphase solid solution' or mixed crystal', as defined herein, therefore, should be taken from the following definitions, which have been adapted to the current improved state of knowledge of such systems:

A monophase (or single-phase or guest-host) solid solution possesses a crystal lattice which is identical with the crystal lattice of one of its components. One component is embedded as the 'guest' in the crystal lattice of the other component, which acts as the 'host'. The X-ray diffraction pattern of such a monophase solid solution is substantially identical to that of one of the components, called the 'host'. Within certain limits, different proportions of the components produce almost identical results.

A multiphase solid solution possesses no precise, uniform crystal lattice. It differs from a physical mixture of its components in that the crystal lattice of at least one of its components is partially or completely altered. In comparison to a physical mixture of the components, which gives an X-ray diffraction diagram that is additive of the diagrams seen for the individual components. The signals in the X-ray diffraction diagram of a multiphase solid solution are broadened, shifted or altered in intensity. In general, different proportions of the components produce different results.

A mixed crystal (or solid compound type) solid solution possesses a precise composition and a uniform crystal lattice, which is different from the crystal lattices of all its components. If different proportions of the components lead, within certain limits, to the same result, then a solid solution is present in which the mixed crystal acts as a host.

For the avoidance of doubt it may also be pointed out that, inter alia, there may also be amorphous structures and mixed aggregates consisting of different particles of different physical type, such as, for example, an aggregate of different components each in pure crystal modification. Such amorphous structures and mixed aggregates cannot be equated with either solid solutions or mixed crystals, and possess different fundamental properties.

As hereinbefore detailed, the monophase solid solutions comprise a plurality of colour compounds. Suitable colour forming materials which may be included in the solid solutions are those given above.

Of particular interest are the following monophase solid solutions:

3-dibutylamino-6-methyl-7-anilinofluoran and 3-dibutylamino-7-dibenzylaminofluoran;

3-dibutylamino-6-methyl-7-anilinofluoran and 3-dibutylamino-7-anilinofluoran;

3-dibutylamino-6-methyl-7-anilinofluoran and 3-diethylamino-7-anilinofluoran;

3-diethylamino-6-methyl-7-anilinofluoran and 3-diethylamino-7-anilinofluoran;

3-dibutylamino-6-methyl-7-anilinofluoran and 3-diethylamino-6-methyl-7-anilinofluoran;

3-dibutylamino-6-methyl-7-anilinofluoran and 3-N-isoamyl-N-ethylamino-6-methyl-7-anilinofluoran;

3-dibutylamino-6-methyl-7-anilinofluoran and 3-N-2-pentyl-N-ethylamino-6-methyl-7-anilinofluoran;

3-dibutylamino-6-methyl-7-anilinofluoran and 3-N-isopropyl-N-ethylamino-6-methyl-7-anilinofluoran;

3-dibutylamino-6-methyl-7-anilinofluoran and 3-N-Cyclohexylmethyl-N-ethylamino-6-methyl-7-anilinofluoran;

3-dibutylamino-6-methyl-7-anilinofluoran and 3-dipropylamino-6-methyl-7-anilinofluoran;

3-dibutylamino-6-methyl-7-anilinofluoran and 3-N-2-butyl-N-ethylamino-6-methyl-7-anilinofluoran;

3-dibutylamino-6-methyl-7-anilinofluoran and 3-N-cyclohexyl-N-methylamino-6-methyl-7-anilinofluoran;

3-dibutylamino-6-methyl-7-anilinofluoran and 3-diethylamino-6-methyl-7-(3-methylanilino) fluoran;

3-dibutylamino-6-methyl-7-anilinofluoran and 3-diethylamino-6-methyl-7-(2,4-dimethylanilino) fluoran;

3-dibutylamino-6-methyl-7-anilinofluoran and 3-dipentylamino-6-methyl-7-anilinofluoran;

3-dibutylamino-6-methyl-7-anilinofluoran and 3-(N-methyl-N-propylamino)-6-methyl-7-anilinofluoran;

3-dibutylamino-6-methyl-7-anilinofluoran and 3-diethylamino-6-chloro-7-anilinofluoran;

3-dibutylamino-6-methyl-7-anilinofluoran and 3-dibutylamino-7-(2-chloroanilino)fluoran;

3-dibutylamino-6-methyl-7-anilinofluoran and 3-N-ethyl-p-toluidino-6-methyl-7-anilinofluoran;

3-dibutylamino-6-methyl-7-anilinofluoran and 3-(N-ethyl-N-tetrahydrofurfurylamino)-6-methyl-7-anilinofluoran;

3-dibutylamino-6-methyl-7-anilinofluoran and 3-(N-ethyl-N-isobutylamino)-6-methyl-7-anilinofluoran;

3-dibutylamino-6-methyl-7-anilinofluoran and 3-N-ethyl-N-ethoxypropylamino-6-methyl-7-anilinofluoran;

3-dibutylamino-6-methyl-7-anilinofluoran and 2,4-dimethyl-6-[(4-dimethylamino)anilino]fluoran 3-N-isoamyl-N-ethylamino-6-methyl-7-anilinofluoran and 3-diethylamino-6-methyl-7-anilinofluoran;

3-diethylamino-6-methyl-7-anilinofluoran and 3-N-propyl-N-methylamino-6-methyl-7-anilinofluoran;

3-diethylamino-6-methyl-7-(3-tolyl)aminofluoran and 3-diethylamino-6-methyl-7-anilinofluoran;

3-dibutylamino-6-methyl-7-anilinofluoran and 3,3-bis(1-octyl-2-methylindol-3-yl)phthalide;

3-dibutylamino-6-methyl-7-anilinofluoran and mixture of 2-phenyl-4-(4-diethylaminophenyl)-4-(4-methoxyphenyl)-6-methyl-7-dimethylamino-3,1-benzoxazine and 2-phenyl-4-(4-diethylaminophenyl)-4-(4-methoxyphenyl)-8-methyl-7-dimethylamino-3,1-benzoxazine;

3-dibutylamino-6-methyl-7-anilinofluoran and 4,4'-[1-methylethylidene)bis(4,1-phenyleneoxy-4,2-quinazolinediyl)] bis[N,N-diethylbenzenamine].

In the above monophase solid solutions the first compound is in a molar ratio of 75 to 99.9% by mole, the second compound is in a ratio of 25 to 0.1% by mole.

Examples of monophase solid solutions comprising two components A and B in the stated ratios are: 3-dibutylamino-6-methyl-7-anilinofluoran (99.9%), 3-diethylamino-6-methyl-7-anilinofluoran (0.1%);

3-dibutylamino-6-methyl-7-anilinofluoran (99%), 3-diethylamino-6-methyl-7-anilinofluoran (1%);

3-dibutylamino-6-methyl-7-anilinofluoran (95%), 3-diethylamino-6-methyl-7-anilinofluoran (5%);

3-dibutylamino-6-methyl-7-anilinofluoran (90%) and 3-N-2-pentyl-N-ethylamino-6-methyl-7-anilinofluoran (10%);

3-dibutylamino-6-methyl-7-anilinofluoran (95%) and 3-N-2-pentyl-N-ethylamino-6-methyl-7-anilinofluoran (5%);

3-dibutylamino-6-methyl-7-anilinofluoran (90%) and 3-N-isopropyl-N-ethylamino-6-methyl-7-anilinofluoran (10%);

3-dibutylamino-6-methyl-7-anilinofluoran (95%) and 3-N-isopropyl-N-ethylamino-6-methyl-7-anilinofluoran (5%);

3-dibutylamino-6-methyl-7-anilinofluoran (90%) and 3-N-Cyclohexylmethyl-N-ethylamino-6-methyl-7-anilinofluoran (10%);

3-dibutylamino-6-methyl-7-anilinofluoran (95%) and 3-N-Cyclohexylmethyl-N-ethylamino-6-methyl-7-anilinofluoran (5%);

3-dibutylamino-6-methyl-7-anilinofluoran (90%) and 3-dipropylamino-6-methyl-7-anilinofluoran (10%);

3-dibutylamino-6-methyl-7-anilinofluoran (95%) and 3-dipropylamino-6-methyl-7-anilinofluoran (5%);

3-dibutylamino-6-methyl-7-anilinofluoran (90%) and 3-N-2-butyl-N-ethylamino-6-methyl-7-anilinofluoran (10%);

3-dibutylamino-6-methyl-7-anilinofluoran (95%) and 3-N-2-butyl-N-ethylamino-6-methyl-7-anilinofluoran (5%);

3-dibutylamino-6-methyl-7-anilinofluoran (90%), 3-diethylamino-6-methyl-7-anilinofluoran (10%);

3-dibutylamino-6-methyl-7-anilinofluoran (85%), 3-diethylamino-6-methyl-7-anilinofluoran (15%);

3-dibutylamino-6-methyl-7-anilinofluoran (80%), 3-diethylamino-6-methyl-7-anilinofluoran (20%);

3-dibutylamino-6-methyl-7-anilinofluoran (95%), 3-N-isoamyl-N-ethylamino-6-methyl-7-anilinofluoran (5%);

3-dibutylamino-6-methyl-7-anilinofluoran (90%), 3-N-isoamyl-N-ethylamino-6-methyl-7-anilinofluoran (10%);

3-dibutylamino-6-methyl-7-anilinofluoran (80%), 3-N-isoamyl-N-ethylamino-6-methyl-7-anilinofluoran (20%);

3-dibutylamino-6-methyl-7-anilinofluoran (90%), 3-N-cyclohexyl-N-methylamino-6-methyl-7-anilinofluoran (10%);

3-diethylamino-6-methyl-7-anilinofluoran (90%), 3-N-isoamyl-N-ethylamino-6-methyl-7-anilinofluoran (10%);

3-diethylamino-6-methyl-7-anilinofluoran (80%), 3-N-isoamyl-N-ethylamino-6-methyl-7-anilinofluoran (20%);

3-diethylamino-6-methyl-7-anilinofluoran (20%), 3-N-isoamyl-N-ethylamino-6-methyl-7-anilinofluoran (80%);

3-diethylamino-6-methyl-7-anilinofluoran (10%), 3-N-isoamyl-N-ethylamino-6-methyl-7-anilinofluoran (90%);

3-diethylamino-6-methyl-7-anilinofluoran (90%), 3-N-propyl-N-methylamino-6-methyl-7-anilinofluoran (10%);

3-diethylamino-6-methyl-7-anilinofluoran (80%), 3-N-propyl-N-methylamino-6-methyl-7-anilinofluoran (20%);

3-diethylamino-6-methyl-7-anilinofluoran (20%), 3-N-propyl-N-methylamino-6-methyl-7-anilinofluoran (80%);

3-diethylamino-6-methyl-7-anilinofluoran (10%), 3-N-propyl-N-methylamino-6-methyl-7-anilinofluoran (90%);

3-diethylamino-6-methyl-7-anilinofluoran (10%), 3-diethylamino-6-methyl-7-(3-tolyl)aminofluoran (90%);

3-diethylamino-6-methyl-7-anilinofluoran (20%), 3-diethylamino-6-methyl-7-(3-tolyl)aminofluoran (80%);

3-dibutylamino-6-methyl-7-anilinofluoran (90%), 3,3-bis(1-octyl-2-methylindol-3-yl)phthalide (10%);

3-dibutylamino-6-methyl-7-anilinofluoran (80%), 3,3-bis(1-octyl-2-methylindol-3-yl)phthalide(20%);

3-dibutylamino-6-methyl-7-anilinofluoran (90%), mixture of 2-phenyl-4-(4-diethylaminophenyl)-4-(4-methoxyphenyl)-6-methyl-7-dimethylamino-3,1-benzoxazine and 2-phenyl-4-(4-diethylaminophenyl)-4-(4-methoxyphenyl)-8-methyl-7-dimethylamino-3,1-benzoxazine(10%);

3-dibutylamino-6-methyl-7-anilinofluoran (80%), mixture of 2-phenyl-4-(4-diethylaminophenyl)-4-(4-methoxyphenyl)-6-methyl-7-dimethylamino-3,1-benzoxazine and 2-phenyl-4-(4-diethylaminophenyl)-4-(4-methoxyphenyl)-8-methyl-7-dimethylamino-3,1-benzoxazine(20%);

3-dibutylamino-6-methyl-7-anilinofluoran (90%), 4,4'-[1-methylethylidene)bis(4,1-phenyleneoxy-4,2-quinazolinediyl)]bis[N,N-diethylbenzenamine](10%);

3-dibutylamino-6-methyl-7-anilinofluoran (80%), 4,4'-[1-methylethylidene)bis(4,1-phenyleneoxy-4,2-quinazolinediyl)]bis[N,N-diethylbenzenamine] (20%).

The monophase solid solutions can be used singly or as a mixture with other colour forming compounds such as triphenylmethanes, lactones, fluorans, benzoxazines and spiropyrans; or they may also be used together with further black colour forming compounds. Examples of such other colour forming compounds are given hereinbefore.

The monophase solid solutions can be prepared by a variety of methods. One such method is the recrystallisation method wherein a physical mixture of the desired components is dissolved, with or without heating, in a suitable solvent or solvent mixture. Suitable solvents include but are not limited to toluene, benzene, xylene, dichlorobenzene, chlorobenzene, 1,2-dichloroethane, methanol, ethanol, isopropanol, n-butanol, acetonitrile, dimethylformamide or mixtures of these solvents with each other and with water. The monophase solid solution is then isolated by crystallisation from the solvent or solvent mixture. This can be brought about by cooling, standing, addition of a further solvent to promote crystallisation or concentration by standard means such as distillation, steam distillation and vacuum distillation. When the monophase solid solution is isolated by concentration it may be advantageous to do so in the presence of a small amount of base, to improve the visual aspect of the isolated product.

Alternatively, monophase solid solutions can be prepared from mixtures of the appropriate starting materials. The technique can be used to produce mixtures of two or more fluorans or phthalides. For example, mixtures of two fluorans are produced by replacing a single starting material with two analogous materials to the same total molar concentration in the reaction. In the case of fluorans, these starting materials are derivatives of amino phenols, phthalic anhydrides, keto acids and diphenylamines.

In addition, the heat sensitive recording material can contain a previously known developer, unless the colour forming performance of the resultant heat sensitive material is disturbed thereby. Such developers are exemplified by but not limited to; 4,4'-isopropylidene bisphenol, 4,4'-sec-butylidene bisphenol, 4,4'-cyclohexylidene bisphenol, 2,2-bis-(4-hydroxyphenyl)-4-methylpentane, 2,2-dimethyl-3,3-di(4-hydroxyphenyl)butane, 2,2'-dihydroxydiphenyl, 1-phenyl-1,1-bis(4-hydroxyphenyl)butane, 4-phenyl-2,2-bis(4-hydroxyphenyl)butane, 1-phenyl-2,2-bis(4-hydroxyphenyl) butane, 2,2-bis(4'-hydroxy-3'-methylphenyl)-4-methylpentane, 2,2-bis(4'-hydroxy-3'-tert-butylphenyl)-4-methylpentane, 4,4'-sec-butylidene-bis (2-methylphenol), 4,4'-isopropylidene-bis (2-tert-butylphenol), 2,2-bis(4'-hydroxy-3'-isopropylphenyl)-4-methylpentane, allyl-4,4-bis (4'-hydroxyphenyl) pentanoate, propargyl-4,4-bis(4'-hydroxyphenyl) pentanoate, n-propyl-4,4-bis (4'-hydroxyphenyl) pentanoate, 2,4-bis (phenylsulfonyl) phenol, 2-(4-methylsulfonyl)-4-(phenylsulfonyl) phenol, 2-(phenylsulfonyl)-4-(4-methylsulfonyl) phenol, 2,4-bis (4-methylphenylsulfonyl) phenol, pentamethylene-bis(4-hydroxybenzoate), 2,2-dimethyl-3,3-di(4-hydroxyphenyl)pentane, 2,2-di(4-hydroxyphenyl)hexane, 4,4'-dihydroxydiphenyl thioether, 1,7-di(4-hydroxyphenylthio)-3,5-dioxaheptane, 2,2'-bis(4-hydroxyphenylthio)diethyl ether, 4,4'-dihydroxy-3,3'-dimethylphenyl thioether; benzyl-4-hydroxybenzoate, ethyl-4-hydroxybenzoate, propyl-4-hydroxybenzoate, isopropyl-4-hydroxybenzoate, butyl-4-hydroxybenzoate, isobutyl-4-hydroxybenzoate, 4,4'-dihydroxydiphenyl sulfone, 2,4'-dihydroxydiphenyl sulfone, 4-hydroxy-4'-methyidiphenyl sulfone, 4-hydroxy-4'-isopropoxydiphenyl sulfone, 4-hydroxy-4'-butoxydiphenyl sulfone, 4,4'-dihydroxy-3,3'-diallyidiphenyl sulfone, 3,4-dihydroxy-4'-methyldiphenyl sulfone, 4,4'-dihydroxy-3,3',5,5'-tetrabromodiphenyl sulfone, 4,4'-bis (p-toluenesulphonylaminocarbonylamino) diphenylmethane, N-p-toluenesulphonyl-N'-phenyl urea, dimethyl 4-hydroxyphthalate, dicyclohexyl 4-hydroxyphthalate, diphenyl 4-hydroxyphthalate, 4-[2-(4-methoxyphenyloxy) ethyloxy]salicylate, 3,5-di-tert-butylsalicylic acid, 3-benzyl salicylic acid, 3-(α-methylbenzyl) salicylic acid, 3-phenyl-5-(α,α-dimethylbenzyl) salicylic acid, 3,5-di-α-methylbenzyl salicylic acid; metal salts of salicylic acid, 2-benzylsulfonylbenzoic acid, 3-cyclohexyl-4-hydroxybenzoic acid, zinc benzoate, zinc 4-nitrobenzoate, 4-(4'-phenoxybutoxy)phthalic acid, 4-(2'-phenoxyethoxy)phthalic acid, 4-(3'-phenylpropyloxy)phthalic acid, mono (2-hydroxyethyl)-5-nitro-isophthalic acid, 5-benzyloxycarbonyl isophthalic acid, 5-(1'-phenylethanesulfonyl) isophthalic acid, bis(1,2-dihydro-1,5-dimethyl-2-phenyl-3H-pyrazol-3-one-O)bis(thiocyanato-N) zinc and mixtures thereof.

In addition, the heat sensitive recording material of the invention can contain a sensitiser.

Representative examples of sensitiser are stearamide, methylol stearamide, p-benzylbiphenyl, m-terphenyl, 2-benzyloxynaphthalene, 4-methoxybiphenyl, dibenzyl oxalate, di(4-methylbenzyl) oxalate, di(4-chlorobenzyl) oxalate, dimethyl phthalate, dibenzyl terephthalate, dibenzyl isophthalate, 1,2-diphenoxyethane, 1,2-bis(4-methylphenoxy) ethane, 1,2-bis(3-methylphenoxy) ethane, 4,4'-dimethyl biphenyl, phenyl-1-hydroxy-2-naphthoate, 4-methylphenyl biphenyl ether, 1,2-bis(3,4-dimethylphenyl) ethane, 2,3,5,6-4'-methyidiphenyl methane, 1,4-diethoxynaphthalene, 1,4-diacetoxybenzene, 1,4-diproprionoxybenzene, o-xylylene-bis(phenyl ether), 4-(m-methylphenoxymethyl) biphenyl, p-hydroxyacetanilide, p-hydroxybutyranilide, p-hydroxynonananilide, p-hydroxylauranilide, p-hydroxyoctadecananilide, N-phenyl-phenylsulphonamide and sensitisers of the formula (3)

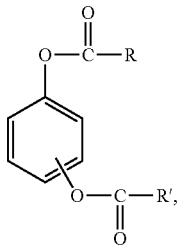

wherein R and R' are identical or different from each other and each represent $C_1$-$C_6$alkyl.

Examples of R and R' are methyl, ethyl, n- or iso-propyl and n-, sec- or tert-butyl.

The substituents R and R' are identical or different from each other and each are preferably $C_1$-$C_4$alkyl, especially methyl or ethyl, in particular ethyl.

The above sensitisers are known or can be prepared according to known methods.

In addition, the heat sensitive recording material of the invention can contain a stabiliser.

Representative stabilisers for use in heat sensitive recording materials include 2,2'-methylene-bis(4-methyl-6-tert-butylphenol), 2,2'-methylene-bis(4-ethyl-6-tert-butylphenol), 4,4'-butylidene-bis(3-methyl-6-tert-butylphenol), 4,4'-thio-bis(2-tert-butyl-5-methylphenol), 1,1,3-tris(2-methyl-4-hydroxy-5-tert-butylphenyl) butane, 1,1,3-tris(2-methyl-4-hydroxy-5-cyclohexylphenyl) butane, bis (3-tert-butyl-4-hydroxy-6-methylphenyl) sulfone, bis (3,5-dibromo-4-hydroxyphenyl) sulfone, 4,4'-sulfinyl bis (2-tert-butyl-5-methylphenol), 2,2'-methylene bis (4,6-di-tert-butylphenyl) phosphate and alkali metal, ammonium and polyvalent metal salts thereof, 4-benzyloxy-4'-(2-methylglycidyloxy) diphenyl sulfone, 4,4'-diglycidyloxydiphenyl sulfone, 1,4-diglycidyloxybenzene, 4-[α-(hydroxymethyl)benzyloxy]-4-hydroxydiphenyl sulfone, metal salts of p-nitrobenzoic acid, metal salts of phthalic acid mono benzyl ester, metal salts of cinnamic acid and mixtures thereof.

Preferred stabilisers are 4,4'-butylidene-bis(3-methyl-6-tert-butyl phenol), 4,4'-thio-bis(2-tert-butyl-5-methylphenol), 1,1,3-tris(2-methyl-4-hydroxy-5-tert-butylphenyl) butane, 1,1,3-tris(2-methyl-4-hydroxy-5-cyclohexylphenyl) butane, 4-benzyloxy-4'-(2-methylglycidyloxy) diphenyl sulfone and mixtures thereof.

The heat sensitive recording material of the invention can be prepared according to conventional methods. For example, at least one colour forming compound, and the inventive composition, and, if desired, at least one sensitiser are mixed in water or a suitable dispersing medium, such as aqueous polyvinyl alcohol, to form an aqueous or other dispersion. If desired a stabiliser is treated in the same manner. The fine particle dispersions thus obtained are combined and then mixed with conventional amounts of binder, filler and lubricant.

Representative binders used for the heat sensitive recording material include polyvinyl alcohol (fully and partially hydrolysed), carboxy, amide, sulfonic and butyral modified polyvinyl alcohols, derivatives of cellulose such as hydroxyethyl cellulose, methyl cellulose, ethyl cellulose, carboxymethyl cellulose and acetyl cellulose, copolymer of styrene-maleic anhydride, copolymer of styrene-butadiene, polyvinyl chloride, polyvinyl acetate, polyacrylamide, polyamide resin and mixtures thereof.

Exemplary fillers which can be used include calcium carbonate (precipitated as well as ground), kaolin, calcined kaolin, aluminium hydroxide, talc, titanium dioxide, zinc oxide, amorphous silica, polystyrene resin, urea-formaldehyde resin, hollow plastic pigment (e.g. Ropaque® from Rohm & Haas) and mixtures thereof.

Representative lubricants for use in heat sensitive recording materials include dispersions or emulsions of stearamide, methylene bisstearamide, polyethylene, carnauba wax, paraffin wax, zinc stearate or calcium stearate and mixtures thereof.

Other additives can also be employed, if necessary. Such additives are for example fluorescent whitening agents and ultraviolet absorbers.

The coating composition so obtained can be applied to a suitable substrate such as paper, plastic sheet, for example, polyethylene or polypropylene, and resin coated paper, and used as the heat sensitive recording material. The system of the invention can be employed for other end use applications using colour forming materials, for example, a temperature indicating material.

The quantity of the coating is usually in the range of 2 to 10 $g/m^2$, most often in the range 3 to 6 $g/m^2$.

The recording material containing such a thermosensitive colouring layer can in addition contain a protective layer and, if desired, an undercoat layer. The undercoat layer may be interposed between the substrate and the thermosensitive colouring layer.

The protective layer usually comprises a water-soluble resin in order to protect the thermosensitive colouring layer. If desired, the protective layer may contain water-soluble resins in combination with water-insoluble resins.

As such resins conventional resins can be employed. Specific examples are: polyvinyl alcohol; silanol and acetoacetyl-modified polyvinyl alcohols; starch and starch derivatives; cellulose derivatives such as methoxycellulose, hydroxyethylcellulose, carboxymethylcellulose, methylcellulose and ethylcellulose; sodium polyacrylate; polyvinyl pyrrolidone; polyacrylamide/acrylic acid ester copolymers; acrylamide/acrylic acid ester/methacrylic acid copolymers; alkali metal salts of styrene/maleic anhydride copolymers; alkali metal salts of isobutylene/maleic anhydride copolymers; polyacrylamide; sodium alginate; gelatin; casein; water-soluble polyesters and carboxyl-group-modified polyvinyl alcohols.

The protective layer may also contain a water-resisting agent such as a polyamide-epichlorohydrin resin, melamine-formaldehyde resin, formaldehyde, glyoxal, zirconium compounds such as ammonium zirconium carbonate or chromium alum.

Furthermore, the protective layer may contain fillers, such as finely-divided inorganic powders, e.g. of calcium carbonate (precipitated or ground), amorphous silica, zinc oxide, titanium oxide, aluminium hydroxide, zinc hydroxide, barium sulphate, clay, talc, surface-treated calcium or silica, or a finely-divided organic powder of, e.g., a urea-formaldehyde resin, a styrene/methacrylic acid copolymer or polystyrene, or mixtures thereof.

The undercoat layer usually contains as its main components a binder resin and a filler.

Specific examples of binder resins for use in the undercoat layer are: polyvinyl alcohol; starch and starch derivatives; cellulose derivatives such as methoxycellulose, hydroxyethylcellulose, carboxymethylcellulose, methylcellulose and ethylcellulose; sodium polyacrylate; polyvinyl pyrrolidone; polyacrylamide/acrylic acid ester copolymers; acrylamide/acrylic acid ester/methacrylic acid copolymers; alkali metal salts of styrene/maleic anhydride copolymers; alkali metal salts of isobutylene/maleic anhydride copolymers; polyacrylamide; sodium alginate; gelatin; casein; water-soluble polymers such as water-soluble polyesters and carboxyl-group-modified polyvinyl alcohols; polyvinyl acetate; polyurethanes; styrene/butadiene copolymers; polyacrylic acid; polyacrylic acid esters; vinyl chloride/vinyl acetate copolymers; polybutylmethacrylate; ethylen/vinylacetate copolymers and styrene/butadiene acrylic derivative copolymers.

Specific examples of fillers for use in the undercoat layer are:

finely-divided inorganic powders, e.g. of calcium carbonate (precipitated or ground), amorphous silica, zinc oxide, titanium oxide, aluminium hydroxide, zinc hydroxide, barium sulphate, clay, talc, surface-treated calcium, silica or calcined clay (eg Ansilex®, from Engelhard Corp.), and finely-divided organic powders of, e.g., urea-formaldehyde resins, styrene/methacrylic acid copolymers and polystyrene and hollow plastic pigments (e.g. Ropaque® from Rohm & Haas).

In addition, the undercoat layer may contain a water-resisting agent. Examples of such agents are given above.

In particular the invention provides low viscos, aqueous dispersions with a high content of colour developer exhibiting good storage stability.

EXAMPLES

50% aqueous dispersions (1-9) of N-p-toluenesulfonyl-N'-3-(p-toluenesulfonyloxy)phenylurea (compound A) are prepared by mixing together 74.3 parts of a 67.3% strength water-wet filter cake of Compound A, 15.4 parts of a 6.5% aqueous solution of dispersing agent and 0.3 parts of biocide as shown in the Table below. The mixture is then milled to a median particle size of about 1 micron. To dispersions 1-6, 10.0 parts of water are subsequently added to produce a 50% aqueous dispersion of compound A. To dispersions 7-9 are added 10.0 parts of a 1% aqueous solution of xanthan gum to produce a 50% aqueous dispersion of compound A.

| | Parts |
|---|---|
| 67.3% strength filter cake of N-p-toluenesulfonyl-N'-3-(p-toluenesulfonyloxy)phenylurea (Compound A) | 74.3 |
| 6.5% aqueous solution of dispersant | 15.4 |
| Biocide | 0.3 |
| Subsequent addition of water (Dispersions 1-6) | 10.0 |
| Subsequent addition of 1% aqueous solution of xanthan gum (Dispersions 7-9) | 10.0 |

The initially produced dispersions 7-9 are each split into 4 samples, i.e. 7, 8 and 9 are subsequently used immediately after preparation for measurement of initial particle size and viscosity; 7a, 8a and 9a are stored for 4 weeks at 4° C. before being used to prepare a heat-sensitive coating composition; 7b, 8b and 9b are stored for 4 weeks at 23° C. before being used to prepare a heat-sensitive coating composition; 7c, 8c and 9c are stored for 4 weeks at 40° C. before being used to prepare a heat-sensitive coating composition.

| | | Average particle size | | Viscosity | |
|---|---|---|---|---|---|
| Dispersion no. | Composition | Initial | After 4 weeks | Initial (at 23° C.) | After 4 weeks |
| 1 | Compound A 74.3 parts<br>6.5% PVA 3-98[a] sol. 15.4 parts<br>Acticide ® MBS 0.3 parts<br>Water 10.0 parts | 0.9 μm | Not measured. | 5.2 Pa s* thixotropic | Not measured |
| 2 | Compound A 74.3 parts<br>6.5% POVAL 203[b] sol. 15.4 pts.<br>Acticide ® MBS[c] 0.3 parts<br>Water 10.0 parts | 1.0 μm | Not measured. | 3.7 Pa s* thixotropic | Not measured |

-continued

| Dispersion no. | Composition | Average particle size Initial | Average particle size After 4 weeks | Viscosity Initial (at 23° C.) | Viscosity After 4 weeks |
|---|---|---|---|---|---|
| 3 | Compound A 74.3 parts<br>6.5% Methyl cellulose solution 15.4 parts<br>Acticide ® MBS 0.3 parts<br>Water 10.0 parts | 1.0 μm | Not measured. | 13 Pa s* thixotropic | Not measured |
| 4 | Compound A 74.3 parts<br>6.5% Gohseran L3266[d] solution 15.4 parts<br>Acticide ® MBS 0.3 parts<br>Water 10.0 parts | 1.1 μm | Not measured. | 53 mPa s** | Not measured Settled layer of gum-like deposit after 1 week at 4, 23 and 40° C. Not redispersible. |
| 5 | Compound A 74.3 parts<br>6.5% Dehscofix ® 930[e] solution 15.4 parts<br>Acticide ®MBS 0.3 parts<br>Water 10.0 parts | 1.0 μm | Not measured. | 90 mPa s** | Not measured Settled layer of gum-like deposit after 1 week at 4, 23 and 40° C. Not redispersible. |
| 6 | Compound A 74.3 parts<br>6.5% Ciba ®Glascol ® LS 16[f] soln 15.4 parts<br>Acticide ® MBS 0.3 parts<br>Water 10.0 parts | 1.0 μm | Not measured. | 90 mPa s** | Not measured Settled layer of gum-like deposit after 1 week at 4, 23 and 40° C. Not redispersible. |
| 7<br>7a, 7b, 7c | Compound A 74.3 parts<br>6.5% Gohseran L3266 solution 15.4 parts<br>Acticide ® MBS 0.3 parts<br>1% xanthan gum solution 10.0 parts | 1.1 μm | 7a at 4° C.: 1.2 μm<br>7b at 23° C.: 1.2 μm<br>7c at 40° C.: 1.3 μm | 520 mPa s** | 7a at 4° C.: 410 mPa s<br>7b at 23° C.: 380 mPa s<br>7c at 40° C.: 300 mPa s |
| 8<br>8a, 8b, 8c | Compound A 74.3 parts<br>6.5% Dehscofix ® 930 solution 15.4 parts<br>Acticide ® MBS 0.3 parts<br>1% xanthan gum solution 10.0 parts | 1.0 μm | 8a at 4° C.: 1.1 μm<br>8b at 23° C.: 1.1 μm<br>8c at 40° C.: 1.3 μm | 550 mPa s** | 8a at 4° C.: 400 mPa s<br>8b at 23° C.: 400 mPa s<br>8c at 40° C.: 520 mPa s |
| 9<br>9a, 9b, 9c | Compound A 74.3 parts<br>6.5% Ciba ®Glascol ® LS 16 soln 15.4 parts<br>Acticide ® MBS 0.3 parts<br>1% xanthan gum solution 10.0 parts | 1.0 μm | 9a at 4° C.: 1.1 μm<br>9b at 23° C.: 1.1 μm<br>9c at 40° C.: 1.1 μm | 565 mPa s** | 9a at 4° C.: 400 mPa s<br>9b at 23° C.: 390 mPa s<br>9c at 40° C.: 395 mPa s |

*Brookfield No. 4 spindle, 30 rpm

**Brookfield No. 2 spindle, 30 rpm

[a]PVA 3-98 is a low viscosity, fully hydrolysed grade of poly vinyl alcohol available from Fluka.

[b]POVAL 203 is a low viscosity, partially hydrolysed grade of poly vinyl alcohol manufactured by Kuraray Co. Ltd.

[c]Acticide ® MBS is a micro biocide based on isothiazolones manufactured by Thor GmbH.

[d]Gohseran L3266 is a sulfonated-poly vinyl alcohol manufactured by Nippon Gohsei

[e]Dehscofix ® 930 is a naphthalene sulfonic acid, polymer with formaldehyde, ammonium salt manufactured by Huntsman Performance Products

[f]Ciba ®Glascol ®LS 16 is a carboxylated acrylic copolymer manufactured by Ciba Specialty Chemicals Inc.

Dispersions no. 1 to 4 show that no stable dispersions with 50% of colour developer I can be obtained with acceptable viscosities or flow properties: in dispersions 1 and 2 the dispersions are thixotropic and their viscosities are very high, i.e. the product does not pour or flow easily, which is a serious drawback. In dispersion 3 the viscosity is very high, and the product does not pour or flow. In dispersion 4 an acceptable viscosity is achieved, but it shows a very poor storage stability. The same, i.e. low viscosity but not storage-stable, is observed in dispersions 5 and 6. The addition of a thickening agent (dispersions 7 to 9) solves these problems.

Preparation of Dispersion A-1 (Colour Former)

| | Parts |
|---|---|
| 3-di(n-butyl)amino-6-methyl-7-anilinofluron | 9.00 |
| 10% PVA 203 solution | 18.00 |
| 20% Surfynol 104[g] in isopropyl alcohol solution | 0.27 |
| Water | 8.73 |

The mixture of the above components is pulverised in a bead mill to a mean particle size of 1.0 μm.

Preparation of Dispersion B-1 (Colour Developer)

| | parts |
|---|---|
| Compound B [N-p-toluenesulfonyl-N'-3-(p-toluenesulfonyloxy)phenylurea]dry powder | 18.00 |
| 10% PVA 203 solution | 12.00 |
| 45% sodium naphthalene sulfonate, polymer with formaldehyde solution | 1.10 |
| water | 40.90 |

The mixture of the above components is pulverised in a bead mill to a mean particle size of 1.0 μm.

Preparation of Dispersion C-1 (Sensitiser)

| | Parts |
|---|---|
| Benzyl-2-Naphthyl Ether | 15.00 |
| 10% PVA 203 solution | 5.00 |
| 45% sodium naphthalene sulfonate, polymer with formaldehyde solution | 0.60 |
| water | 39.40 |

The mixture of the above components is pulverised in a bead mill to a mean particle size of 1.0 μm.

Preparation of Dispersion D-1 (Pigment)

| | parts |
|---|---|
| Socal P3[h] precipitated calcium carbonate | 40.00 |
| 40% sodium polyacrylate solution | 0.40 |
| water | 119.60 |

[h]Socal® P3 is a precipitated calcium carbonate manufactured by Solvay S.A.

The mixture of the above components is pulverised in a bead mill to a mean particle size of 1.0 μm.

Example 1

36 parts of Dispersion A-1, 36 parts of Dispersion 7a, 60 parts of Dispersion C-1, 160 parts of Dispersion D-1, 29.4 parts of a 17% zinc stearate dispersion (Hidorin F115, Chukyo Europe), 45 parts of 20% PVA 203 solution and 2.2 parts of Ciba®Tinopal®ABP-Z Liquid are mixed together with stirring.

The coating composition thus obtained is applied with a dry coatweight of 6 g/m$^2$ to a base paper (pre-coated with Ansilex® calcined clay, Engelhard Corporation) weighing 50 g/m$^2$. After drying, the resulting heat sensitive paper is calendered to 430 Bekk seconds smoothness.

Example 2

A coating mixture is prepared as in Example 1 with the exception that 36 parts of Dispersion 7a are replaced with 36 parts of Dispersion 7b.

Example 3

A coating mixture is prepared as in Example 1 with the exception that 36 parts of Dispersion 7a are replaced with 36 parts of Dispersion 7c.

Example 4

A coating mixture is prepared as in Example 1 with the exception that 36 parts of Dispersion 7a are replaced with 36 parts of Dispersion 8a.

Example 5

A coating mixture is prepared as in Example 1 with the exception that 36 parts of Dispersion 7a are replaced with 36 parts of Dispersion 8b.

Example 6

A coating mixture is prepared as in Example 1 with the exception that 36 parts of Dispersion 7a are replaced with 36 parts of Dispersion 8c.

Example 7

A coating mixture is prepared as in Example 1 with the exception that 36 parts of Dispersion 7a are replaced with 36 parts of Dispersion 9a.

Example 8

A coating mixture is prepared as in Example 1 with the exception that 36 parts of Dispersion 7a are replaced with 36 parts of Dispersion 9b.

Example 9

A coating mixture is prepared as in Example 1 with the exception that 36 parts of Dispersion 7a are replaced with 36 parts of Dispersion 9c.

Comparative Example

A coating mixture is prepared as in Example 1 with the exception that 36 parts of Dispersion 7a are replaced with 72 parts of freshly prepared Dispersion B-1.

Evaluation of Heat Sensitive Recording Materials

The heat sensitive recording materials prepared according to the invention are evaluated as described below and the results of the evaluations are summarised in Table 1.

Image Optical Density

Using a Thermal Tester (Model 200 manufactured by Atlantek Inc.), each heat sensitive recording material is printed at an applied energy of 0.50 mJ/dot and the density of the recorded image thus obtained is measured with a Macbeth 1200 Series densitometer.

Oil Resistance

After printing, the heat sensitive recording material is gravure printed with cottonseed oil and then stored for 24 hours in an oven maintained at 40° C. The optical density of the recorded portion is then measured with a Macbeth densitometer.

TABLE 1

| Example | Initial image intensity | Oil resistance |
|---|---|---|
| 1 | 1.32 | 1.30 |
| 2 | 1.32 | 1.31 |
| 3 | 1.33 | 1.31 |
| 4 | 1.33 | 1.30 |
| 5 | 1.32 | 1.31 |

TABLE 1-continued

| Example | Initial image intensity | Oil resistance |
|---|---|---|
| 6 | 1.33 | 1.31 |
| 7 | 1.30 | 1.32 |
| 8 | 1.30 | 1.31 |
| 9 | 1.31 | 1.32 |
| Comp. Example | 1.30 | 1.30 |

The results show that each of the above aqueous dispersions of N-p-toluenesulfonyl-N'-3-(p-toluenesulfonyloxy) phenylyurea (compound A) perform in a similar way to the dry powder equivalent product when incorporated into a heat sensitive recording material. The heat sensitive recording materials thus produced yield black images of high optical density with high stability to chemical influences such as cottonseed oil.

The invention claimed is:

1. A composition comprising a colour developer I:

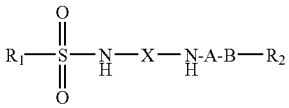

, wherein $R_1$ is phenyl or naphthyl, which can be unsubstituted or substituted by $C_1$-$C_8$alkyl, $C_1$-$C_8$-alkoxy or halogen; or $C_1$-$C_{20}$ alkyl, which can be unsubstituted or substituted by $C_1$-$C_8$-alkoxy or halogen;

X is a group of the formula —C(═NH)—, —C(═S)— or —C(═O)—;

A is unsubstituted or substituted phenylene, naphthylene or $C_1$-$C_{12}$alkylene, or is an unsubstituted or substituted heterocyclic group;

B is a linking group of formula —O—$SO_2$—, —$SO_2$—O—, —NH—$SO_2$—, —$SO_2$—NH—, —S—$SO_2$—, —O—CO—NH—, —NH—CO—, —NH—CO—O—, —S—CO—NH—, —S—CS—NH—, —CO—NH—$SO_2$—, —O—CO—NH—$SO_2$—, —NH═CH—, —CO—NH—CO—, —S—, —CO—, —O—, —$SO_2$—NH—CO—, —O—CO—O— and —O—PO—$(OR_2)_2$; and $R_2$ is aryl, which can be unsubstituted or substituted by $C_1$-$C_8$alkyl, halogen-substituted $C_1$-$C_8$alkoxy-substituted $C_1$-$C_8$alkoxy, halogen-substituted $C_1$-$C_8$alkoxy or halogen; or benzyl, which can be substituted by $C_1$-$C_8$alkyl, halogen-substituted $C_1$-$C_8$alkyl, $C_1$-$C_8$alkoxy-substituted $C_1$-$C_8$alkoxy, halogen-substituted $C_1$-$C_8$alkoxy or halogen;

or $C_1$-$C_{20}$alkyl, which can be unsubstituted or substituted by $C_1$-$C_8$alkoxy, halogen, phenyl or naphthyl; and a) 0.1 to 5 dry parts by weight of an anionic dispersant per 100 dry parts of the colour developer I, wherein the anionic dispersant is an ammonium salt of naphthalene sulfonic acid formaldehyde condensate, a carboxylated polymer, a carboxylated acrylic copolymer, or a mixture thereof; and b) 0.01 to 2.0 dry parts per weight of a thickening agent per 100 parts of the colour developer I.

2. The composition according to claim 1, wherein $R_1$ is phenyl, which is substituted by $C_1$-$C_4$alkyl;

X is a group of the formula —C(═O)—;

A is phenylene, which is unsubstituted or substituted by $C_1$-$C_4$alkyl or halogen;

B is a linking group of formula —O—$SO_2$— or —O—; and $R_2$ is phenyl, naphthyl or benzyl, which is unsubstituted or substituted by $C_1$-$C_4$alkyl or halogen.

3. The composition according to claim 1, wherein the thickening agent is selected from the group consisting of xanthan gum, sodium alginate, water-soluble carboxylates, acrylamide polymers or copolymers, acrylic acid, ethyl acrylate, and methacrylic acid.

4. The composition according to claim 1, further comprising a biocide.

5. The composition according to claim 1 comprising:

a) at least 50% by weight of the colour developer I;

b) the anionic dispersant, in an amount from 0.1 to 5 dry parts per a dry 100 parts of the colour developer I;

c) the thickening agent, in an amount from 0.01 to 2.0 dry parts per a dry 100 parts of the colour developer I;

d) optionally a biocide; and e) water, which adds up to 100%.

6. A heat-sensitive recording material comprising:

a) a colour forming compound, and b) the composition according claim 1.

7. A process for the manufacturing of the composition according claim 1, comprising:

a) mixing the colour developer I, the anionic dispersant, and water, optionally with a biocide to obtain a mixture;

b) milling the mixture to obtain a treated mixture having an average particle size in the range of from 0.2 to 2.0 μm; and c) blending the treated mixture of step b) with the thickening agent.

8. Paper, wherein the composition according to claim 1 is coated onto the paper.

* * * * *